US008144069B2

(12) United States Patent
Sadowski et al.

(10) Patent No.: US 8,144,069 B2
(45) Date of Patent: Mar. 27, 2012

(54) HIDDEN WIDEBAND ANTENNA

(76) Inventors: Bogdan Sadowski, Cary, NC (US); Zofia Sadowska, Cary, NC (US)

( * ) Notice: Subject to any disclaimer, the term of this patent is extended or adjusted under 35 U.S.C. 154(b) by 530 days.

(21) Appl. No.: 12/243,974

(22) Filed: Oct. 2, 2008

(65) Prior Publication Data

US 2010/0085269 A1 Apr. 8, 2010

(51) Int. Cl.
*H01Q 9/16* (2006.01)
*H01Q 1/36* (2006.01)

(52) U.S. Cl. ..... 343/806; 343/895; 343/795

(58) Field of Classification Search ..... 343/806, 343/895, 793, 795, 873
See application file for complete search history.

(56) References Cited

U.S. PATENT DOCUMENTS 3,231,894 A * 1/1966 Nagai ..... 343/806
3,355,740 A * 11/1967 Mayes ..... 343/792.5
3,383,693 A * 5/1968 Kahn et al. ..... 343/792.5
3,587,105 A * 6/1971 Neilson ..... 343/710
4,987,424 A * 1/1991 Tamura et al. ..... 343/795
6,630,910 B2 * 10/2003 Forster et al. ..... 343/806
7,123,207 B2 * 10/2006 Yazdandoost et al. ..... 343/795

* cited by examiner

*Primary Examiner* — Hoang V Nguyen

(57) ABSTRACT

A low-cost compact wideband antenna (200) has two triangular-shaped arms (500 and 510) formed by winding the conductive wire into a zigzag pattern. The two arms (500 and 510) form a compact bow-tie type antenna having equivalent electrical size larger then its mechanical dimensions. Two straight wires (530 and 540) are joined to, and electrically connected between two respective largest segment ends of two zigzag structures. The compact wideband antenna (200) is hidden inside the decorative household item (210) to provide antenna having external appearance appropriate for modern home furnishing setting with improved broadband characteristic across VHF and UHF bands but without the inconvenience of the large size.

3 Claims, 7 Drawing Sheets

HIDDEN WIDEBAND ANTENNA

FIELD OF THE INVENTION

This invention relates to electronic circuits, and more particularly to antennas and TV receivers.

BACKGROUND OF THE INVENTION

Wideband antennas are widely used in variety of applications including TV broadcast, radar, radio astronomy and radio-communications. Indoor antenna for TV broadcast reception is required to cover particularly broad range of frequencies across VHF and UHF bands. Heretofore, separate antennas were used to receive VHF and UHF bands. Output signals from both antennas were combined together into a single-connector output.

FIG. 1 is a perspective view of such prior art antenna. Referring now to FIG. 1, a prior art indoor TV antenna assembly includes a V-shaped dipole antenna for VHF reception, comprising of two long arms 100 and 110, and a loop antenna 120, of round or rectangular shape, for UHF band reception. Both antennas are joined to a decorative base 130, made of insulator material. The base 130 also serves as an enclosure for signal combining network and wiring to the output F-type connector 140.

V-shaped dipole and loop antennas, made from thin conductors, do not have a particularly broadband characteristics, thus the quality of the TV receptions is compromised at the edges of both VHF and UHF bands.

Such prior art antenna is also not a particularly attractive accessory in modern home furnishing setting due to its size and appearance. Nowadays, trend in home furnishing demands that antenna's exterior appearance has to be similar to or at least in harmony with furniture, accent lighting and other decorative items.

SUMMARY OF THE INVENTION

Accordingly, it is an object of the present invention to provide low-cost wideband antenna capable of quality reception of all over-the-air TV channels, throughout the VHF and UHF bands, and having external appearance appropriate for, and in harmony with, modern home furnishing setting. More specifically, compact wire antenna is hidden inside the decorative household item to provide improved broadband characteristic across VHF and UHF bands without the inconvenience of large size and indiscreet appearance.

DETAILED DESCRIPTION OF THE INVENTION

Preferred embodiments of the present invention will now be described in details, with reference to the accompanying drawings. This invention may, however, be embodied in many different forms and should not be construed as limited to the embodiments set forth herein. Rather, these embodiments are provided so that the disclosure will be thorough and complete, and will fully convey the scope of the invention to those skilled in the art.

Figure 1:
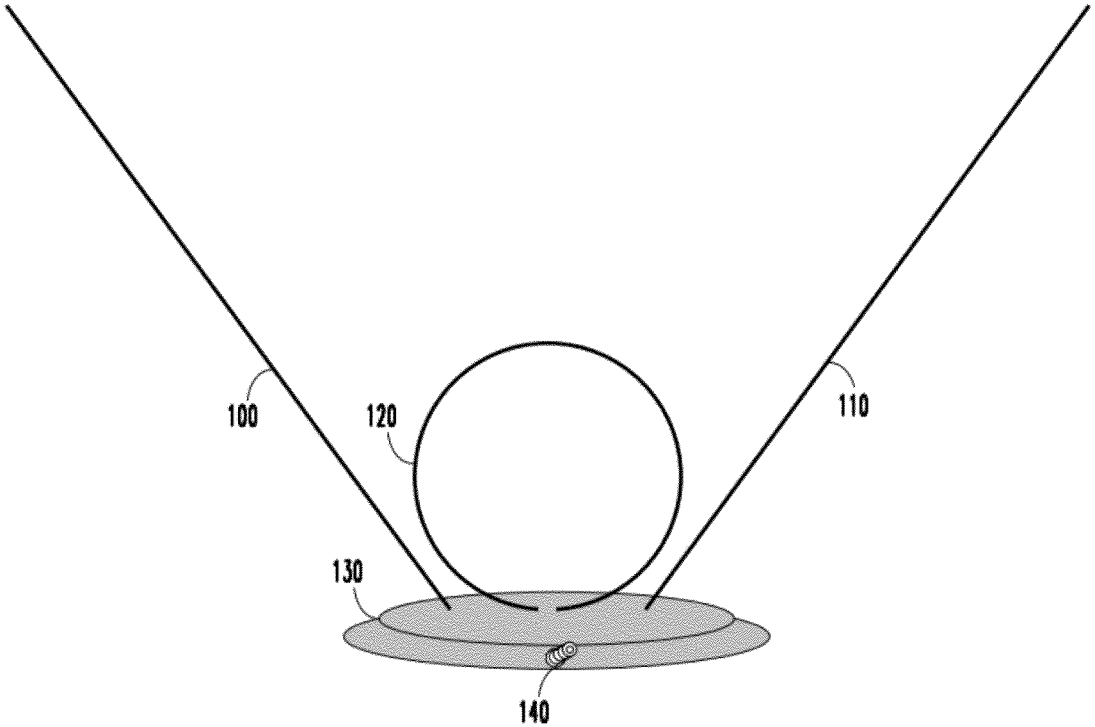
FIG. 1 PRIOR ART
FIG. 1 is a perspective view of a prior art indoor TV antenna.
Figure 2A:
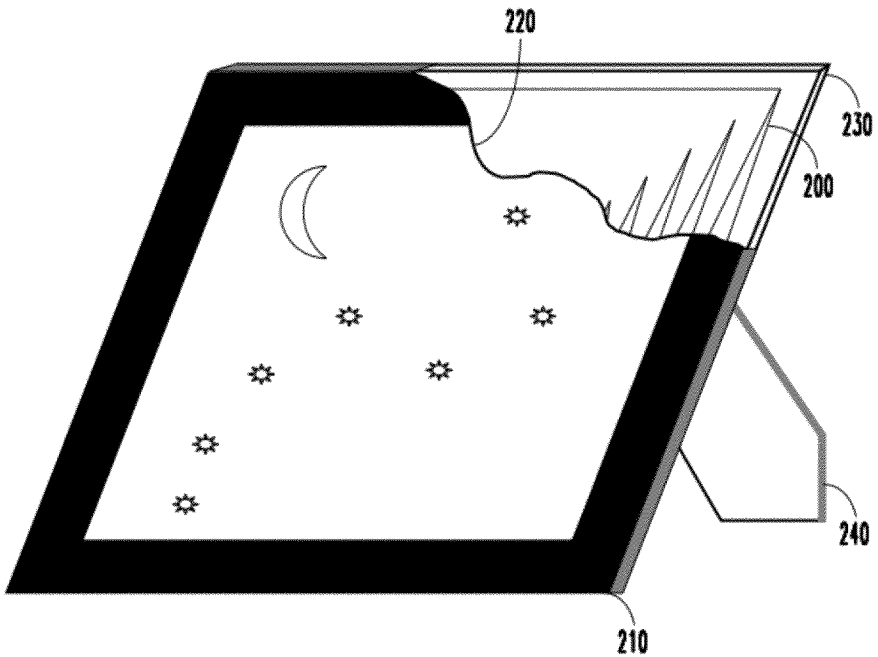
FIG. 2A is a perspective front view of the hidden wideband antenna according to the present invention.
Figure 2B:
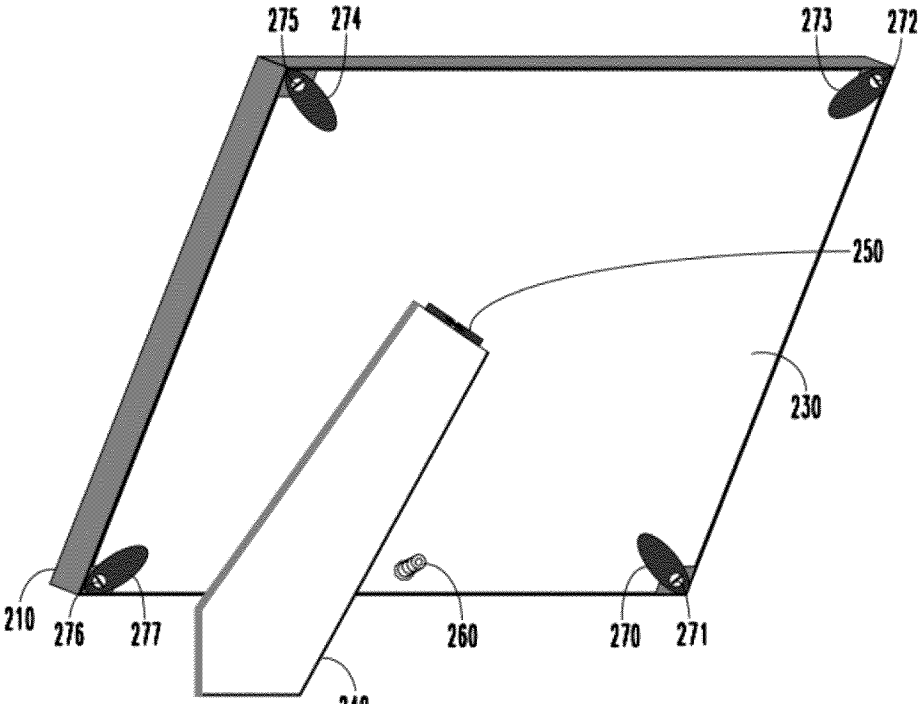
FIG. 2B is a perspective back view of the hidden wideband antenna according to the present invention.
Figure 2C:
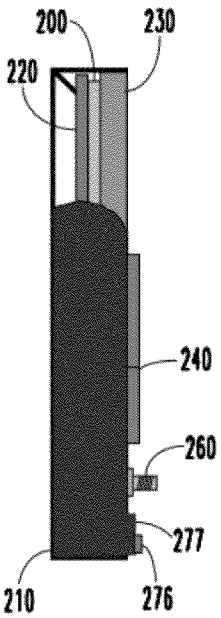
FIG. 2C is a side view of the hidden wideband antenna according to the present invention.

Referring now to FIG. 2A, FIG. 2B and FIG. 2C, hidden wideband antenna, according to the present invention, includes a wideband antenna 200. Wideband antenna 200 is attached to a back cover 230. Gluing is the preferred method of attachment, however other attachment methods are considered being within the scope of the invention. A support leg 240 is joined to the back cover 230 by a hinge mechanism 250. A picture 220 is inserted inside a frame 210. Picture 220 may include protective material covering its front, such as thin glass or transparent plastic, and this shall still be considered within the scope of this invention. In the preferred embodiment, the frame 210, as well as the back cover 230 and the support leg 240, are all made from plastic material, but any non-conductive material, such as wood or paper (or combination of both), are still considered being within the scope of this invention. The back cover 230 is inserted next to the picture 220 and both are held inside the frame 210 by means of a force applied by clench attachments 270, 273, 274 and 277. The clench attachments 270, 273, 274 and 277 are joined to the frame 210 using screws 271, 272, 275 and 276 respectively. An output connector 260 is attached to the back cover 230. In the preferred embodiment, female F-type 75-Ohm coaxial connector is used, but this should not be construed as a limitation on the scope of the invention.

Figure 3:
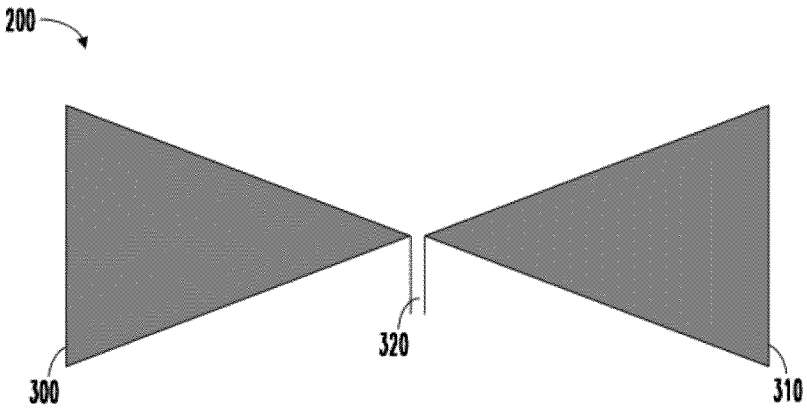
FIG. 3 depicts conductor sheet type embodiment of the wideband antenna.

Referring now to FIG. 3, one embodiment of the wideband antenna 200 is formed of a metal sheet into two arms 300 and 310 of a triangular shape. Copper metal sheet is used, but any other types of conductive sheet shall still be considered being within the scope of this invention. The two arms 300 and 310 are aligned to form a bow-tie type of antenna. The design of the bow-tie type of antenna and individual components thereof are well known to those having skill in the art and need not to be described further herein. A feed line 320 electrically connects the two arms 300 and 310 to the output connector 260. A non-uniform feed line is preferred, but this should not be construed as a limitation on the scope of the invention. Other feed arrangements containing additional signal conditioning circuitries, such as, but not limited to a filter, a balun or an in-line amplifier, shall still be considered being within the scope of this invention.

Figure 4:
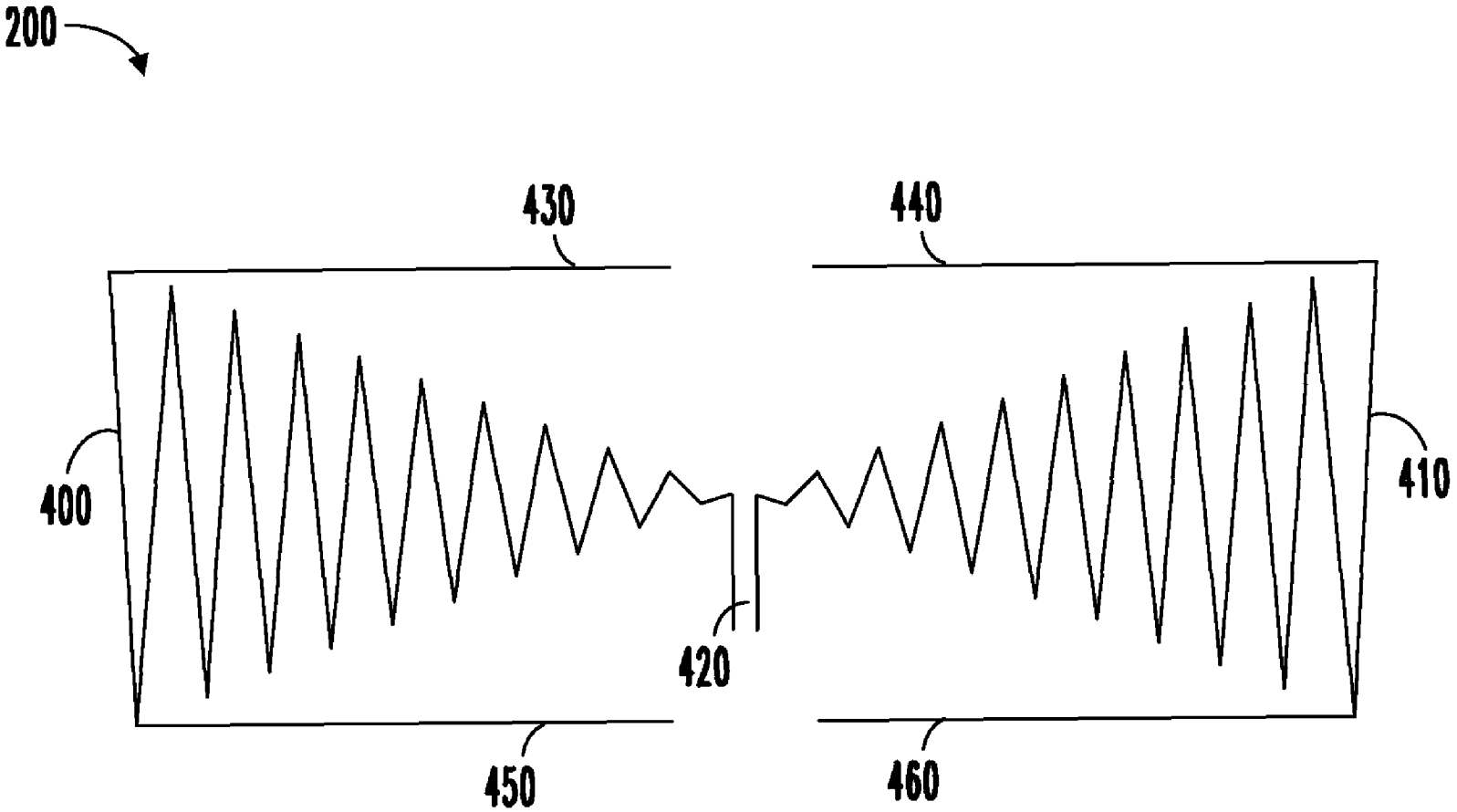
FIG. 4 depicts wire type embodiment of the wideband antenna.

Referring now to FIG. 4, wire type embodiment of the wideband antenna 200 has two triangular-shaped arms 400 and 410 formed by winding the conductive wire into a zigzag pattern. Copper wire is preferred, but any other types of conductive wire, bare or covered by thin insulation material, shall still be considered being within the scope of this invention. Two straight wires are joined, and electrically connected, to each end of the largest segment of each zigzag structure. Straight wires 430 and 450 are joined to arm 400. Straight wires 440 and 460 are joined to arm 410. The two arms 400 and 410 are aligned to form a compact bow-tie type of antenna having equivalent electrical size larger then its mechanical dimensions. The design of the bow-tie type of antenna, individual components thereof and methods of increasing effective electrical size of an antenna are well known to those having skill in the art and need not to be described further herein. A feed line 420 electrically connects the two arms 400 and 410 to the output connector 260. A non-uniform feed line is preferred, but this should not be construed as a limitation on the scope of the invention. Other feed arrangements containing additional signal conditioning circuitries, such as, but not limited to a filter, a balun or an in-line amplifier, shall still be considered being within the scope of this invention.

Each of the straight wires may be extended to the length equal to length of each arm and two pairs can be electrically connected at the respective joint points, being virtual ground points for symmetric antenna structure. Each of the straight wires, if insulated, may be extended beyond the length of each arm and both ramifications shall still be considered being within the scope of this invention.

Figure 5:
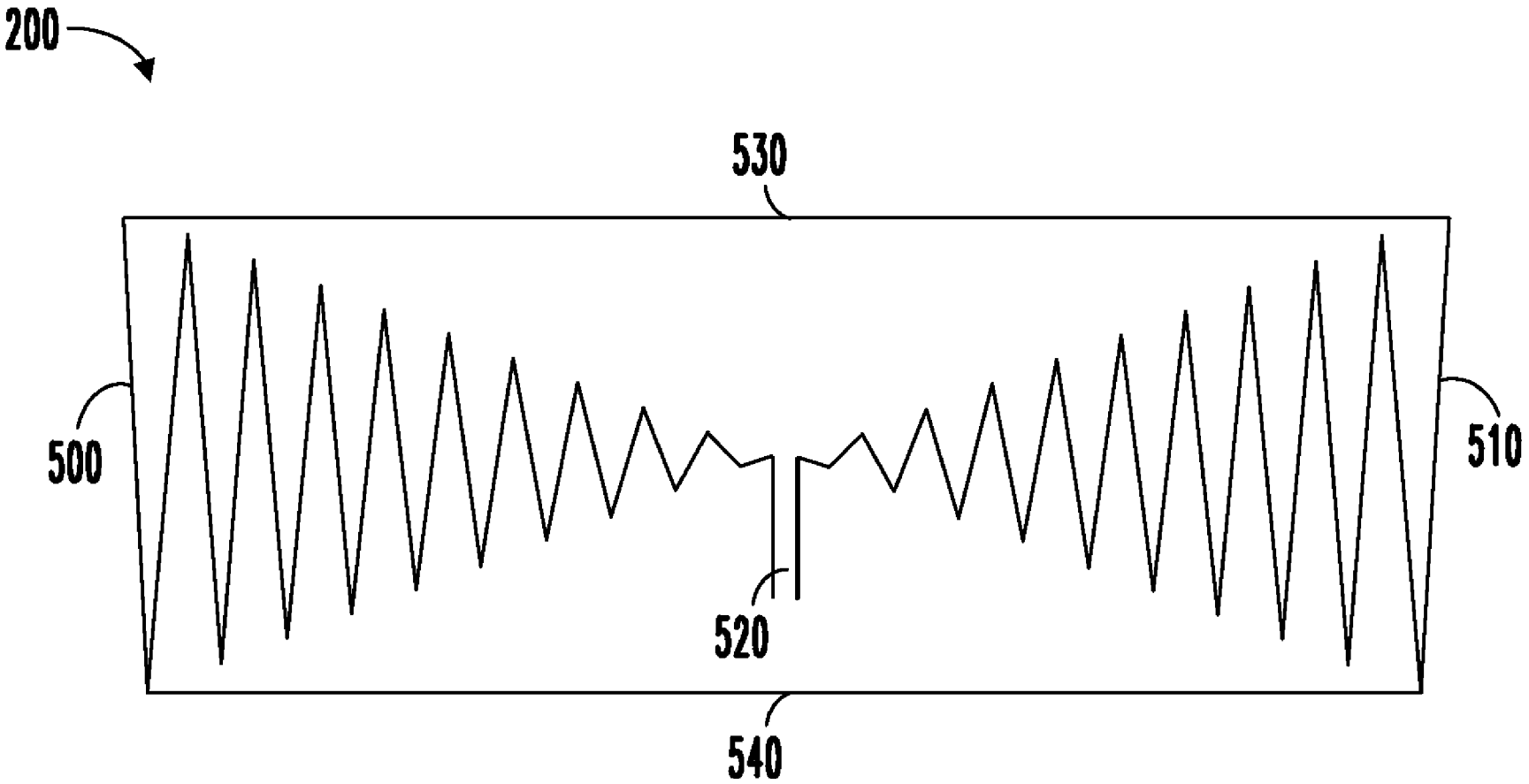
FIG. 5 depicts preferred embodiment of the wideband antenna.

Referring now to FIG. 5, preferred embodiment of the wideband antenna 200 has two triangular-shaped arms 500 and 510 formed by winding the conductive wire into a zigzag pattern. Copper wire is preferred, but any other types of conductive wire, bare or covered by thin insulation material, shall still be considered being within the scope of this invention. Two straight wires 530 and 540 are joined to, and electrically connected between two respective largest segment ends of two zigzag structures. The two arms 500 and 510 form a compact bow-tie type of antenna having equivalent electrical size larger then its mechanical dimensions. The design of the bow-tie type of antenna, individual components thereof and methods of increasing effective electrical size of an antenna are well known to those having skill in the art and need not to be described further herein. A feed line 520 electrically connects the two arms 500 and 510 to the output connector 260. A non-uniform feed line is preferred, but this should not be construed as a limitation on the scope of the invention. Other feed arrangements containing additional signal conditioning circuitries, such as, but not limited to a filter, a balun or an in-line amplifier, shall still be considered being within the scope of this invention.

Thus the invention provides a low-cost wideband antenna capable of quality reception of all over-the-air TV channels, throughout the VHF and UHF bands, and having external appearance appropriate for, and in harmony with, modern home furnishing setting.

Use of the described above antenna to signal transmitting, rather then receiving, shall still be considered being within the scope of this invention.

Other types of antenna, such as, but not limited to a loop antenna or a patch antenna, hidden inside the decorative household item, such as, but not limited to a picture frame, shall still be considered being within the scope of this invention. The design of the individual components described above is well known to those having skill in the art and need not to be described further herein.

While the description above contains many specificities, these should not be construed as limitations on the scope of the invention, but as merely providing examples of some of the presently preferred embodiments of the invention.

Accordingly, the scope of the invention should not be determined by the embodiment(s) illustrated, but by the appended claims and their legal equivalents.

What is claimed is:

1. An antenna comprising, in combination:

a wire zigzag pattern, forming one arm of said antenna; and a second wire zigzag pattern, forming the second arm of said antenna; and a straight wire connected between two highest points of said two zigzag patterns; and a second straight wire connected between two lowest points of said two zigzag patterns.

2. An antenna according to claim 1 wherein:

said second wire zigzag pattern is a mirror image of the first wire zigzag pattern to form a symmetrical, electrically long antenna.

3. An antenna according to claim 1 wherein:

the antenna is hidden inside a decorative household item.

* * * * *